US006614416B1

(12) United States Patent
Yamamoto et al.

(10) Patent No.: US 6,614,416 B1
(45) Date of Patent: Sep. 2, 2003

(54) DRIVING METHOD AND DRIVING DEVICE OF LIQUID CRYSTAL PANEL

(75) Inventors: Tomohiko Yamamoto, Nara (JP); Naoto Inoue, Shiki-gun (JP); Keiichi Tanaka, Tenri (JP); Koji Fujiwara, Tenri (JP); Hideki Ichioka, Nabari (JP)

(73) Assignee: Sharp Kabushiki Kaisha, Osaka (JP)

( * ) Notice: Subject to any disclaimer, the term of this patent is extended or adjusted under 35 U.S.C. 154(b) by 364 days.

(21) Appl. No.: 09/687,655

(22) Filed: Oct. 13, 2000

(30) Foreign Application Priority Data

Oct. 13, 1999 (JP) ..... 11-290764

(51) Int. Cl.[7] ..... G09G 3/36

(52) U.S. Cl. ..... 345/94; 345/95; 345/96; 345/101

(58) Field of Search ..... 345/94, 95, 96, 345/99, 101, 104, 87

(56) References Cited

U.S. PATENT DOCUMENTS 5,583,533 A * 12/1996 Moriyama ..... 345/94
5,831,605 A * 11/1998 Yasui et al. ..... 345/211
5,940,057 A * 8/1999 Lien et al. ..... 345/89
6,232,944 B1 * 5/2001 Kumagawa et al. ..... 345/98

FOREIGN PATENT DOCUMENTS

JP 204718/1990 8/1990
JP 191821/1992 7/1992
JP 07-114004 5/1995

* cited by examiner

*Primary Examiner*—Amare Mengistu
*Assistant Examiner*—Jimmy H Nguyen
(74) *Attorney, Agent, or Firm*—David G. Conlin; William J. Daley, Jr.; Edwards & Angell, LLP

(57) ABSTRACT

A wave A1 is used as a signal inputted to a liquid crystal panel via an operational amplifier OP. The wave A1 is a superimposed wave made up of, for example, a first rectangular wave to be the base of a driving signal and a second wave capable of increasing respective amplitudes of the first wave in rising and falling directions. Because a wave A3 is superimposed, using the wave A1 as the driving signal of the liquid crystal panel surely results in increase in a quantity of charges with which respective pixels of the liquid crystal panel are supplied at early stages of writing, more than simply applying the wave A2 to the liquid crystal panel. Consequently, even when a charge supplying ability of a reference voltage line is considerably low, a desired charging quantity can surely be obtained in respective pixels within desired writing time, thereby preventing crosstalk having different degrees depending on a location even when a charge supplying ability for the respective pixels of the liquid crystal panel is considerably low.

9 Claims, 12 Drawing Sheets

A1
A2
A3

DRIVING METHOD AND DRIVING DEVICE OF LIQUID CRYSTAL PANEL

FIELD OF THE INVENTION

The present invention relates to a driving method and driving device of a liquid crystal panel having a switching element, for example, such as a Thin Film Transistor (TFT), and in particular to the driving method and driving device of a liquid crystal panel which compensates for the shortage of charges supplied to respective pixels of the liquid crystal panel.

BACKGROUND OF THE INVENTION

In recent years, a liquid crystal display device adopting a TFT (hereinafter referred to as TFT-LCD) has been increased in size and become higher definition, and there is such a tendency that a demand for higher display quality of the TFT-LCD has been increased as the TFT-LCD is developed with multimedia.

In such a development of the TFT-LCD which has been increased in size and become higher definition, problems such as shortened time for writing a picture signal onto a pixel and a serious wiring delay due to respective buses have been noted.

Here, driving methods of the TFT-LCD can roughly be divided into two methods: line reversal driving and dot reversal driving.

The line reversal driving refers to driving which reverses a polarity of a signal line in one to several horizontal time (=about 16.7 mS/number of scanning lines), which has the characteristic of resisting crosstalk in a vertical direction (crosstalk in the vertical direction occurs less often). In addition, since a voltage is applied to a liquid crystal by synthesizing a common electrode potential and a signal line potential, the line reversal driving has such an advantage that the voltage of not more than a threshold value of the liquid crystal can be obtained from the common electrode potential, and thereby an amplitude of the signal line potential is required to have as low a voltage as a dynamic range Vdy of the liquid crystal.

On the other hand, the dot reversal driving refers to driving which reverses the polarity of the signal line in one to several horizontal time (=about 16.7 mS/number of scanning lines) while also reversing a polarity of an adjacent signal line, which has the characteristic of resisting crosstalk in both of the vertical and horizontal directions. Despite its superior display quality, however, this driving method requires that the common electrode potential be constant, and thus has such a drawback that the amplitude of the signal line potential needs to have a high voltage of $2\times(Vth+Vdy)$, where Vth is the threshold value of the liquid crystal.

Meanwhile, the difference in amplitude of the signal line potentials in the line and dot reversal driving corresponds to difference in endurance of their source drivers, which results in difference in driver cost between the two driving methods. Therefore, when attempting to provide a low-cost and high-quality TFT-LCD, it is more effective to compose the TFT-LCD by using a driver which conducts the line reversal driving in which the signal line potential is more voltage-saving compared with the dot reversal driving.

However, in the line reversal driving, a charge supplying ability of a common electrode line which supplies respective pixels of the TFT-LCD with charges becomes deficient at early stages of writing. Here, the common electrode line is provided parallel to a scanning line which is provided on a pixel substrate, on a counter substrate opposite to the pixel substrate on which the TFT is provided. FIG. 6 shows an equivalent circuit of the common electrode line. This equivalent circuit is, though having inputs at both ends, basically made up of an integration circuit (low-pass filter) of FIG. 7. When a rectangular wave is inputted to this circuit, as shown in FIG. 7, an output waveform thereof grows dull due to a characteristic of the integration circuit, i.e. this means the shortage of the charge supplying ability at the early stages of writing. Note that, in FIG. 6, the waveform grows duller as it moves from the both ends toward the center.

When the charge supplying ability of the common electrode line becomes thus insufficient, crosstalk appears in the horizontal direction, i.e. the direction parallel to the scanning line. This crosstalk in the horizontal direction, as shown in FIG. 8, appears particularly when, for example, displaying a black square 52 at the center of a screen having a background of a half tone part 51 (part of the screen indicated by vertical hatching). More specifically, the sides of the black square 52 become whiter than the half tone part 51.

Here, by forming a thick common electrode line for example, crosstalk in the horizontal direction can be settled on the side of a panel. However, this method results in reducing a numerical aperture, thereby being less preferable.

Accordingly, for example, Japanese Unexamined Patent Publication No. 191821/1992 (Tokukaihei 4-191821 published on Jul. 10, 1992) discloses a technique of reducing crosstalk in the horizontal direction without reducing the numerical aperture of the panel by incorporating a panel impedance which is connected to the common electrode of the TFT-LCD into a negative feedback circuit adopting an operational amplifier. The structure of the circuit according to the publication is shown in FIG. 9.

In this driving circuit, an original input (signal inputted to the operational amplifier OP) is amplified by a value obtained by dividing a synthetic impedance which is composed of resistors R1 and R2, a capacitor C, and a panel impedance of a liquid crystal panel 55, by a resistor R3. Utilizing the characteristic of the negative feedback of the operational amplifier OP, a voltage which is determined in anticipation of a reduction in voltage inside of the panel is inputted to the common electrode line of the liquid crystal panel 55, thereby reducing crosstalk in the horizontal direction. The original input, waveforms of the output and input of the liquid crystal panel 55 at that time are shown in FIGS. 10(*a*) through 10(*c*).

Note that, a resistor R4 which is connected to a ground input of the operational amplifier OP is to determine an offset voltage of the counter electrode of the liquid crystal panel 55. In addition, respective values (circuit constants) of the resistors R1, R2, R3 and R4, and the capacitor C, etc., need to be optimized.

However, a problem arises when the charge supplying ability of the common electrode line is considerably low, i.e. the driving above cannot fully settle crosstalk in the horizontal direction. The reason is that, when the charge supplying ability of the common electrode line is considerably low, the degree of crosstalk in the horizontal direction becomes different between in the vicinity of the black square and in the vicinity of the input when the black square 52 appears in the middle of the screen having the background of the half tone part 51.

Thus, as shown in FIG. 11, when, for example, the circuit constants of the negative feedback circuit are set so that crosstalk disappears in the vicinity of the input, crosstalk in the horizontal direction still remains in the vicinity of the black square. On the other hand, as shown in FIG. 12, when, for example, the circuit constants of the negative feedback circuit are set so that crosstalk disappears in the vicinity of the black square, the crosstalk in the horizontal direction in the vicinity of the input appears in a different form which is blacker than the background of the half tone part 51. Note that, it has been known that even if, for example, the circuit constants of the negative feedback circuit are set so that crosstalk at an arbitrary position between the vicinities of the input and black square disappears, different types of crosstalk appear in the vicinities of the input and black square.

Note that, in FIGS. 11 and 12, hatching density (interval between vertical lines) shows the thickness of the half tone in qualitative terms. Namely, the denser the hatching is, the thicker the half tone is, while the sparser the hatching is, the thinner the half tone is.

The reason for thus resulting in different degrees of crosstalk in the horizontal direction is as follows: when the charge supplying ability of the common electrode line is considerably low, that is, when a time constant CR which is determined by a wiring resistor R and load capacitance (load capability) C of the common electrode line is too large, and a desired voltage is not reached within desired writing time, a charging quantity of pixels reacts sensitively with respect to fluctuation in the time constant CR. R is constant when determining the time constant CR. However, the time constant CR fluctuates as C fluctuates depending on the content of display.

Incidentally, even when the time constant CR is at its maximum (i.e. when displaying entirely black display in a normally white mode), the charging quantity of pixels can remain constant regardless of what contents are displayed on the screen, provided that a desired voltage has been attained within desired writing time. In this case, crosstalk does not occur in the horizontal direction.

SUMMARY OF THE INVENTION

It is an object of the present invention to provide a driving method and driving device of a liquid crystal panel capable of preventing crosstalk having different degrees depending on a location while increasing display quality even when a charge supplying ability with respect to each pixel of the liquid crystal panel is considerably low.

In order to attain the foregoing object, in the driving method of the liquid crystal panel according to the present invention, in a driving method adopting a driving signal which periodically drives respective pixels of the liquid crystal panel, the driving signal includes a compensating signal for compensating for a deficiency in charges with which the respective pixels are supplied at the beginning of respective driving which is repeated periodically.

In the foregoing structure, since the driving signal includes the compensating signal, a quantity of charges in each pixel which is deficient at the beginning of respective driving which is repeated periodically, i.e. at early stages of writing, is compensated by the compensating signal, regardless of whether it is large or small. Consequently, a desired charging quantity can be obtained in each pixel within desired writing time, and when, for example, performing black display in the middle of a screen having a half-tone background, the charging quantity of the respective pixels can be made constant at the both ends of the black display at the early stages of writing, thereby surely preventing crosstalk having different degrees depending on a location due to difference in a charging quantity while surely improving display quality.

Further, in order to attain the foregoing object, the driving device of the liquid crystal panel according to the present invention, in a driving device of the liquid crystal panel in which each pixel of the liquid crystal panel is driven by the driving signal, includes an adder circuit for generating the driving signal by addition of a first wave and a second wave, the first wave being a rectangular wave to be a base of the driving signal, the second wave capable of increasing respective amplitudes of the first wave in rising and falling directions when the first wave rises and falls, respectively.

In the foregoing structure, by addition of the first wave of the rectangular wave which becomes the base of the driving signal and the second wave (e.g. a rectangular wave or a sinusoidal wave) performed by the adder circuit, the amplitudes of the first wave in the rising and falling directions increase compared with those in a state before the addition of the second wave. Note that, the foregoing addition may be performed by various methods such as inversion addition or addition of subtracted wave. By adopting a signal after addition as the driving signal of the liquid crystal panel, a quantity of charges with which respective pixels of the liquid crystal panel are supplied at the early stages of writing surely increases compared with that before the addition.

Consequently, even when a time constant of wiring for supplying charges is increased with the increasing size of the liquid crystal panel while a quantity of charges in shortage in respective pixels due to wiring delay becomes considerably large, the use of the foregoing driving signal enables the respective pixels to surely obtain a desired charging quantity within desired writing time. Consequently, when, for example, performing black display in the middle of a screen having a half-tone background, the charging quantity of the respective pixels can be made constant at the both ends of the black display, thereby surely preventing crosstalk having different degrees depending on a location due to difference in a charging quantity while surely improving display quality.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 3(*b*) is a waveform diagram of a signal outputted from the liquid crystal panel; and FIG. 3(*c*) is a waveform diagram of a signal inputted to the liquid crystal panel.

FIG. 4(*b*) is an explanatory drawing showing a relation between time and voltage in the signal inputted to the operational amplifier.

FIG. 10(*b*) is a waveform diagram of a signal outputted from the liquid crystal panel; and FIG. 10(*c*) is a waveform diagram of a signal inputted to the liquid crystal panel.

DETAILED DESCRIPTION OF THE PREFERRED EMBODIMENTS

First Embodiment

The following will explain one embodiment of the present invention with reference to drawings. Before explaining a liquid crystal panel driving method of the present invention, a liquid crystal panel will be explained first.

Figure 2:
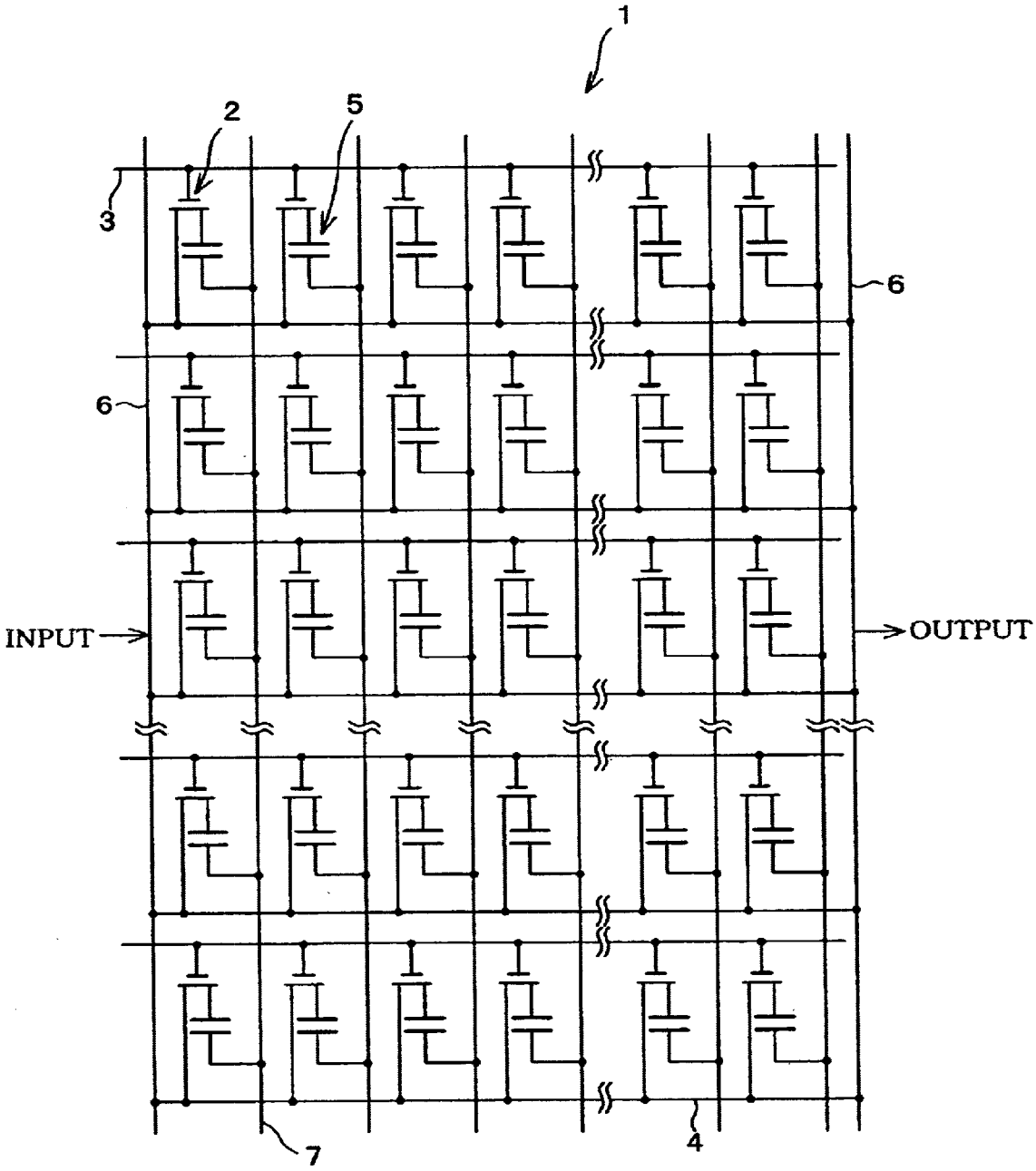
FIG. 2 is a circuit diagram showing a schematic structure of the liquid crystal panel.

FIG. 2 shows a circuit diagram of a liquid crystal panel 1. In the liquid crystal panel 1, a liquid crystal is held between a pixel substrate and a counter substrate. On the pixel substrate, a plurality of switching elements 2 each of which has three terminals, a plurality of scanning lines 3, a plurality of reference voltage lines 4 and a plurality of pixel electrodes 5 are provided.

The switching element 2, which is made of a TFT for example, is disposed in a matrix. The scanning line 3 is disposed corresponding to each row of switching elements 2, and connected to first terminals of the switching elements 2 in each row. The reference voltage line 4 is disposed corresponding to each row of switching elements 2 and parallel to the scanning line 3, and connected to second terminals of the switching elements 2 in each row. Both ends of the reference voltage line 4 are connected to respective reference voltage main lines 6 which extend perpendicularly to the reference voltage line 4. The pixel electrode 5 which is connected to a third terminal of each switching element 2 is provided for every pixel.

On the other hand, a counter electrode (not shown) and a signal line 7 are provided on the counter substrate. The counter electrode is disposed opposing to each pixel electrode 5. The signal line 7 is disposed corresponding to each column of the counter electrodes and connected to the counter electrode in each column. Note that, there may be an arrangement in which the signal line 7 concurrently serves as the counter electrode.

In the foregoing structure, when a reference voltage (driving signal) of the reference voltage line 4 is applied to the pixel electrode 5 via the switching element 2, and when a potential in accordance with a picture signal is given to the counter electrode via the signal line 7, a voltage is then applied to the liquid crystal between the pixel electrode 5 and the counter electrode, which drives the liquid crystal.

Thus, the liquid crystal panel 1 of the present embodiment has a so-called opposite source structure in which the scanning line 3 and signal line 7 are separately formed on different substrates, i.e. the scanning line 3 and signal line 7 are provided not to intersect on a single substrate, thereby reducing line defects caused by the intersection of the scanning line 3 and signal line 7. Thus, yield is improved and manufacturing costs are reduced.

Figure 6:
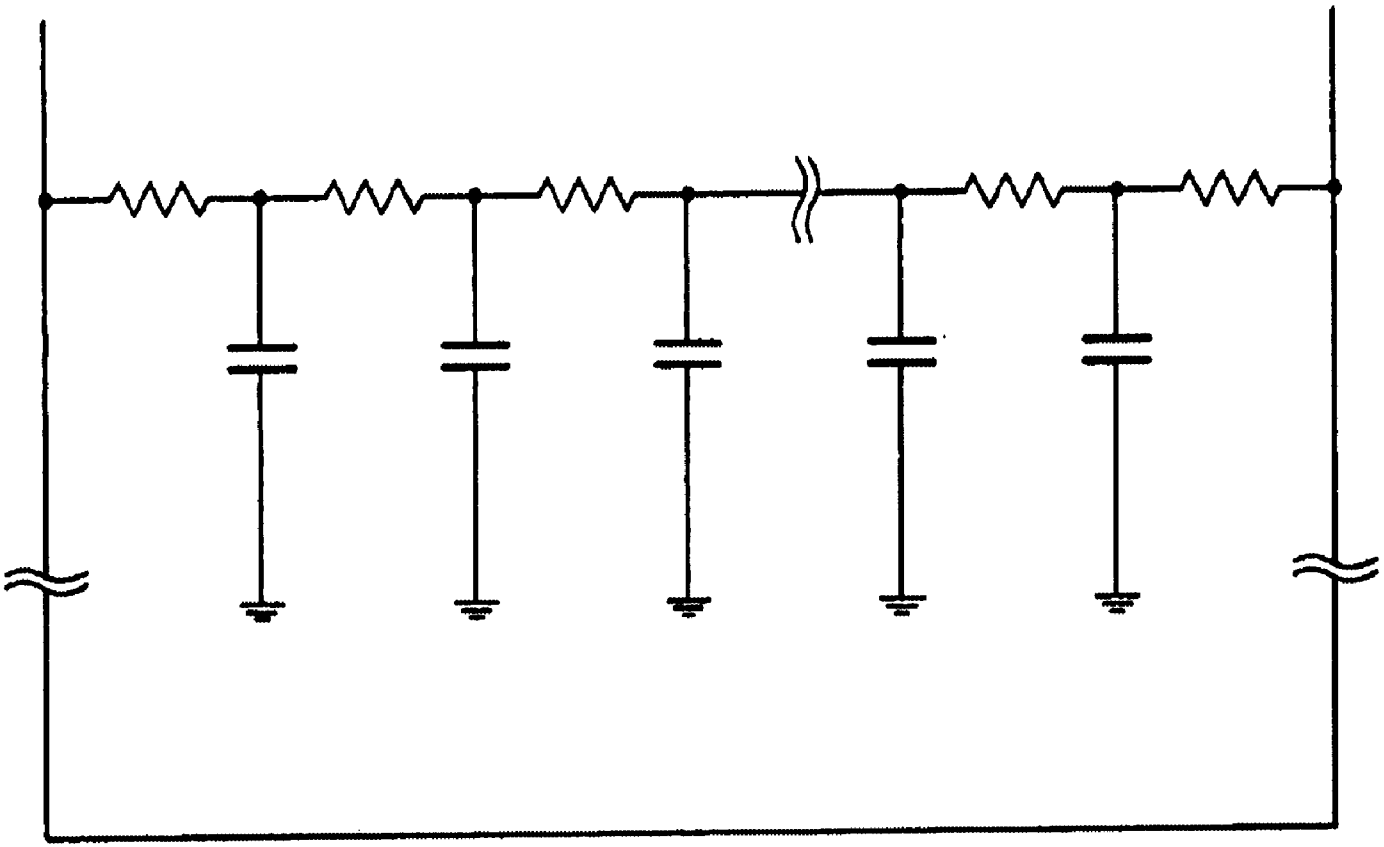
FIG. 6 PRIOR ART
FIG. 6 is a circuit diagram showing an equivalent circuit of a common electrode line of the liquid crystal panel.
Figure 7:
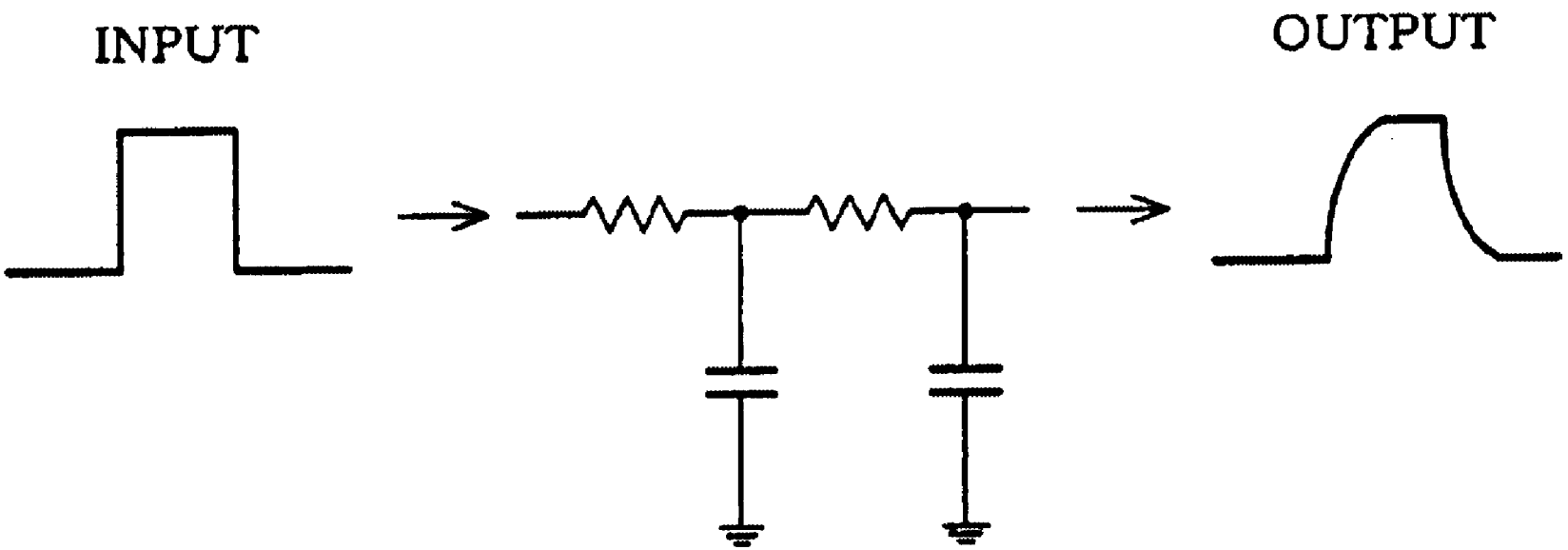
FIG. 7 PRIOR ART
FIG. 7 is an explanatory drawing showing an input waveform and output waveform in the equivalent circuit.
Figure 8:
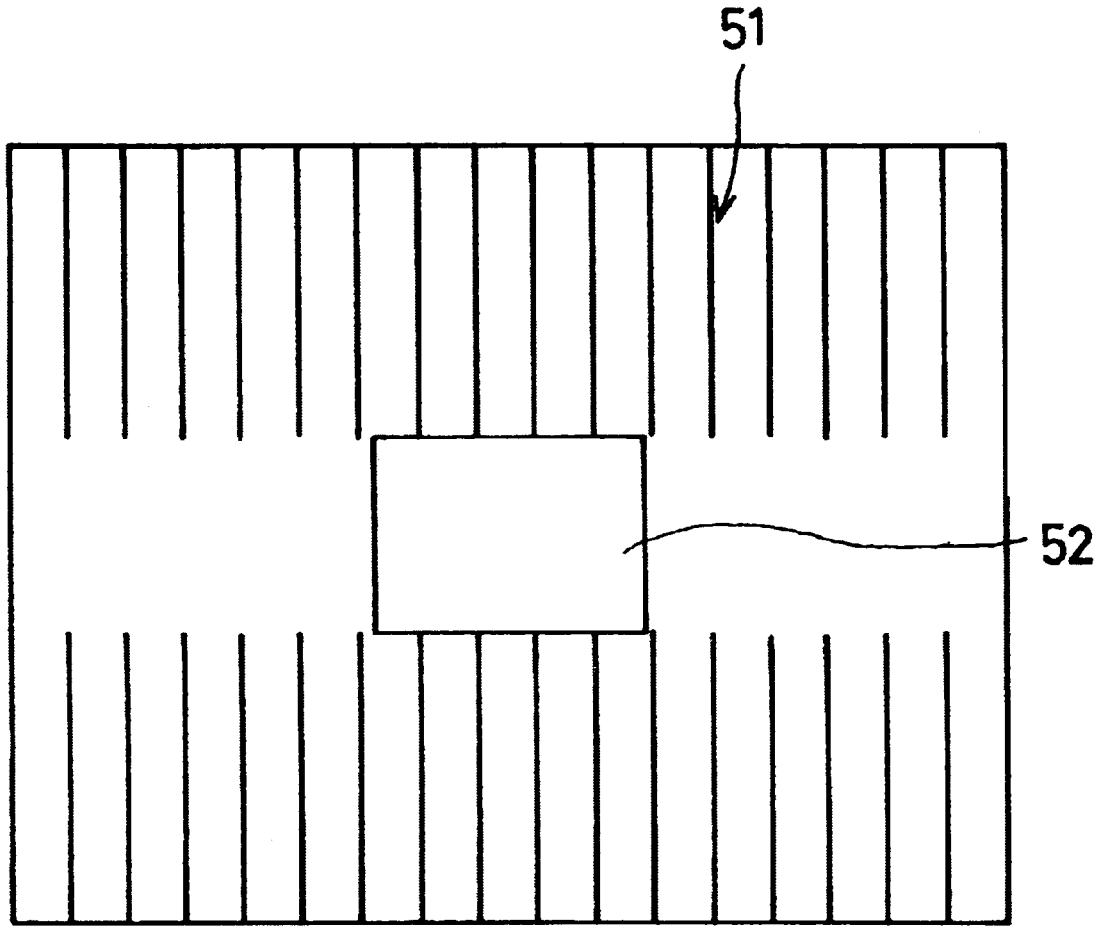
FIG. 8 PRIOR ART
FIG. 8 is an explanatory drawing showing crosstalk when displaying a black square in the middle of a screen having a half-tone background.
Figure 9:
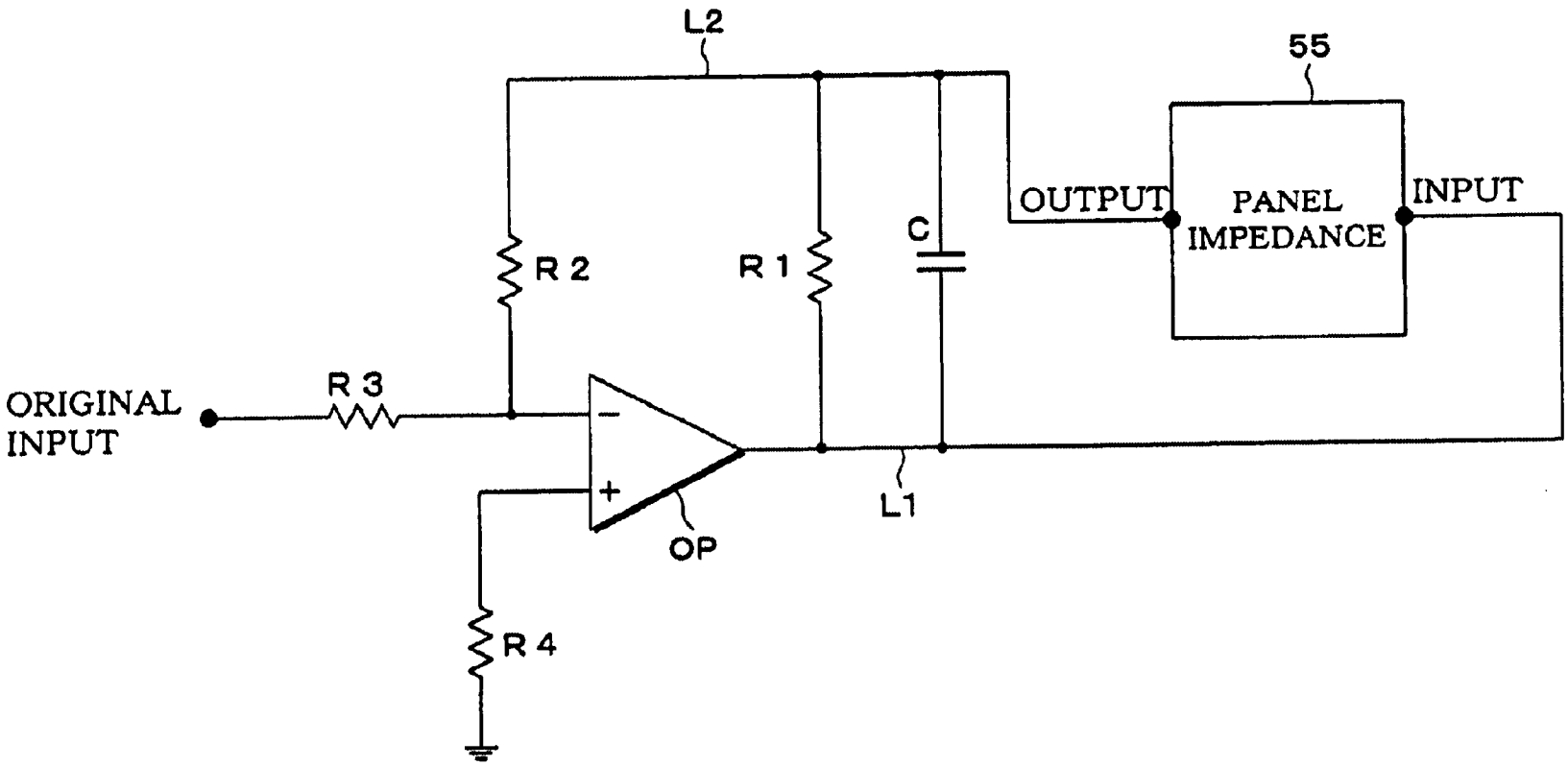
FIG. 9 PRIOR ART
FIG. 9 is an explanatory drawing showing a schematic structure of a conventional liquid crystal panel driving circuit.
Figure 10C:
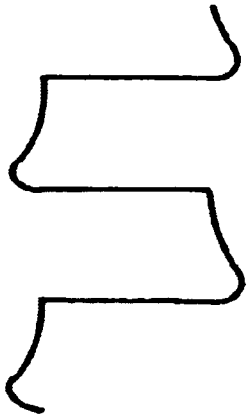
FIG.10(c) PRIOR ART
FIG. 10(*a*) is a waveform diagram of a signal inputted to an operational amplifier provided in the driving circuit.
Figure 10B:
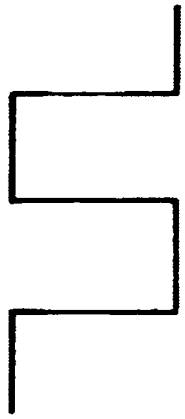
FIG.10(b) PRIOR ART
Figure 10A:
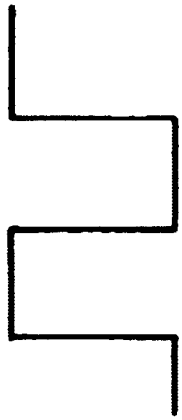
FIG.10(a) PRIOR ART
Figure 11:
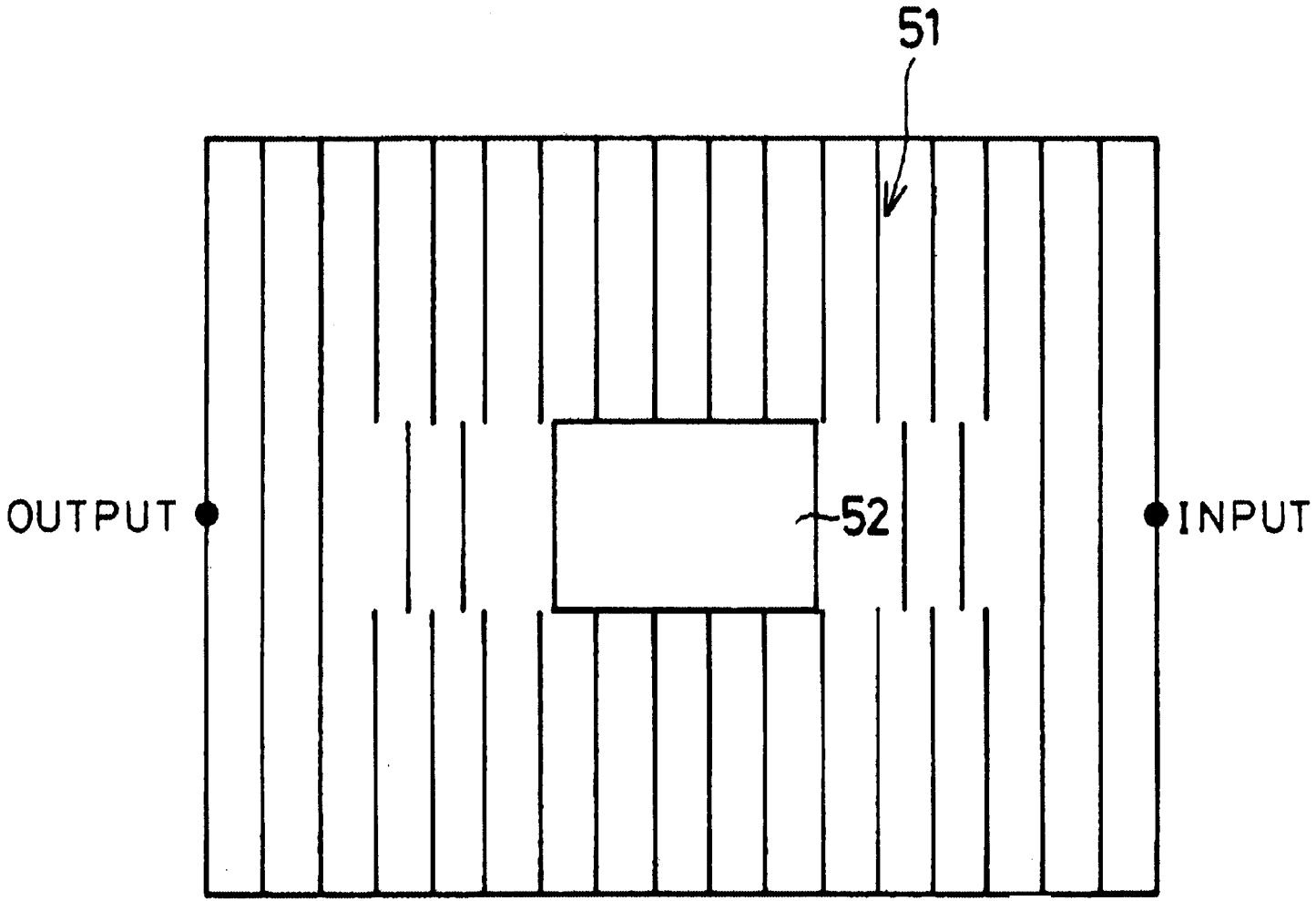
FIG.11 PRIOR ART
FIG. 11 is an explanatory drawing showing crosstalk in a display screen when circuit constants of the driving circuit are set so that crosstalk disappears in the vicinity of an input.
Figure 12:
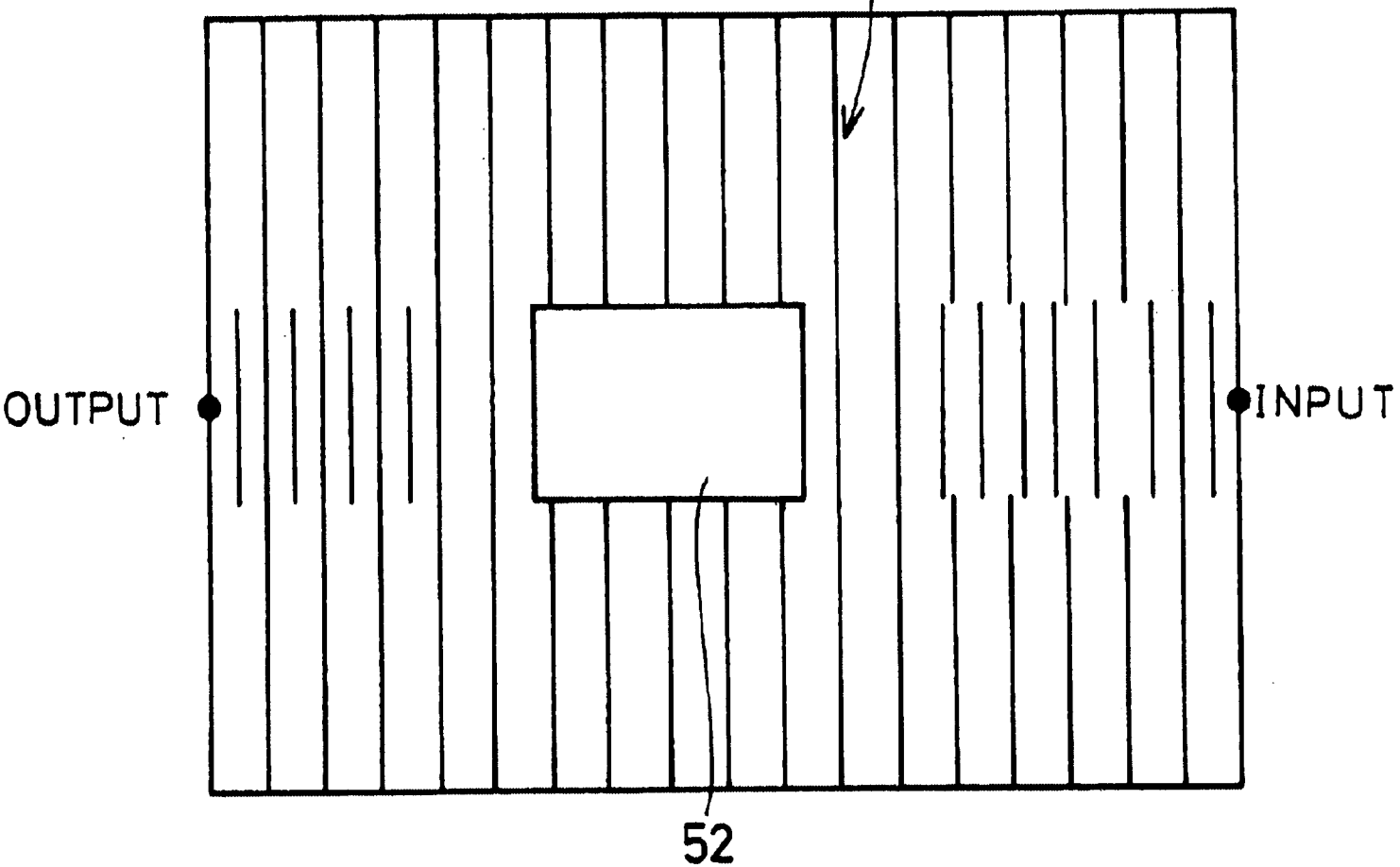
FIG.12 PRIOR ART
FIG. 12 is an explanatory drawing showing crosstalk in the display screen when the circuit constants are set so that crosstalk disappears in the vicinity of the black square.

Meanwhile, an equivalent circuit of the reference voltage line 4 is also basically composed of the integration circuit as shown in FIGS. 6 and 7. Accordingly, if a rectangular wave is inputted to the reference voltage line 4 as the driving signal, its output waveform becomes dull due to the characteristic of the integration circuit, which results in a shortage of a charge supplying ability at the early stages of writing.

Figure 1:
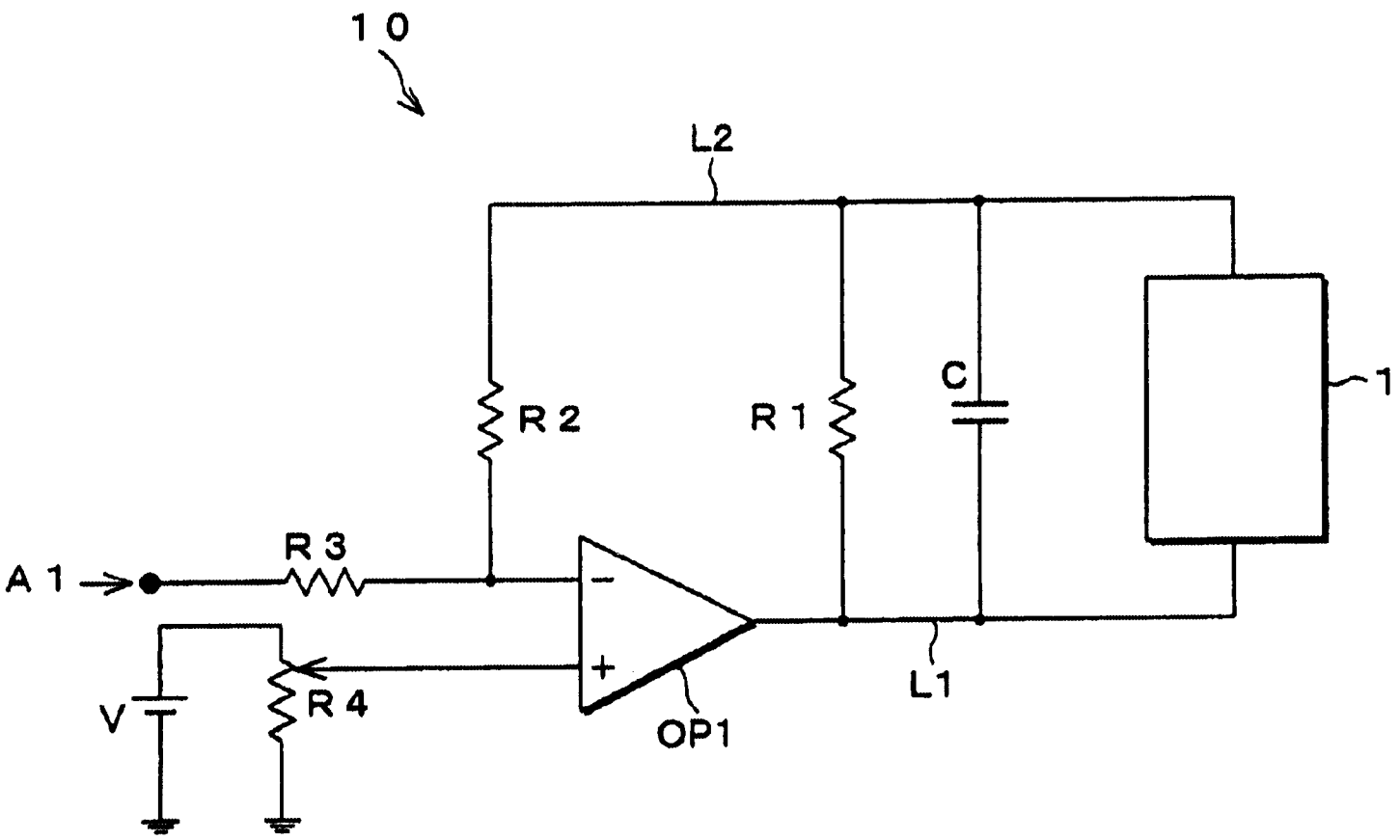
FIG. 1 is an explanatory view showing a schematic structure of a liquid crystal panel driving circuit according to one embodiment of the present invention.

Therefore, in the present embodiment, there is provided a driving circuit 10 which has an arrangement in which the reference voltage main lines 6 bind the reference voltage lines 4 on the sides of input and output, and as shown in FIG. 1, a voltage applying line L1 is connected to the reference voltage main line 6 on the input side while a voltage feedback line L2 is connected to the reference voltage main line 6 on the output side, and negative feedback is applied between the input and output. The following will explain the driving circuit 10.

In the driving circuit 10, an original input (reference voltage) is inputted to an inverse input terminal of an operational amplifier OP1 through a resistor R3. An output terminal of the operational amplifier OP1 is connected to the input of the liquid crystal panel 1 (reference voltage main line 6 on the input side) through the voltage applying line L1.

Further, the output of the liquid crystal panel 1 (reference voltage main line 6 on the output side) is connected to the inverse input terminal of the operational amplifier OP1 through the voltage feedback line L2 and a resistor R2 in this order. Therefore, an amplification factor of the original input is determined based on values of the resistors R2 and R3.

The voltage feedback line L2 is connected to the voltage applying line L1 through a resistor R1 and the capacitor C which are connected in parallel. Since the resistor R1 is variable, a feedback quantity from the voltage feedback line L2 to the voltage applying line L1 can be changed by changing resistance value of R1.

A resistor R4 which is connected to a non-inverse input terminal of the operational amplifier OP1 is to determine an offset voltage of the counter electrode of the liquid crystal panel 1. A power source V is serially connected to the resistor R4, and a central voltage of an input waveform is set according to respective values of R4 and V.

In the structure of the driving circuit 10, the original input driving signal (e.g. rectangular waveform) is amplified by a value obtained by dividing a synthetic impedance of the resistors R1 and R2, the capacitor C and the panel impedance of the liquid crystal panel 1, by the resistor R3. Utilizing a negative feedback characteristic of the operational amplifier OP1, a voltage which is determined in anticipation of a reduction in voltage inside of the panel is inputted to the reference voltage line 4 via the reference voltage main line 6, thereby reducing crosstalk caused by shortage in the charge supplying ability of the reference voltage line 4. Evidently, respective values (circuit constants) of the resistors R1, R2, R3 and R4, and the capacitor C, etc., need to be optimized.

Figures 3A, 3B, 3C:
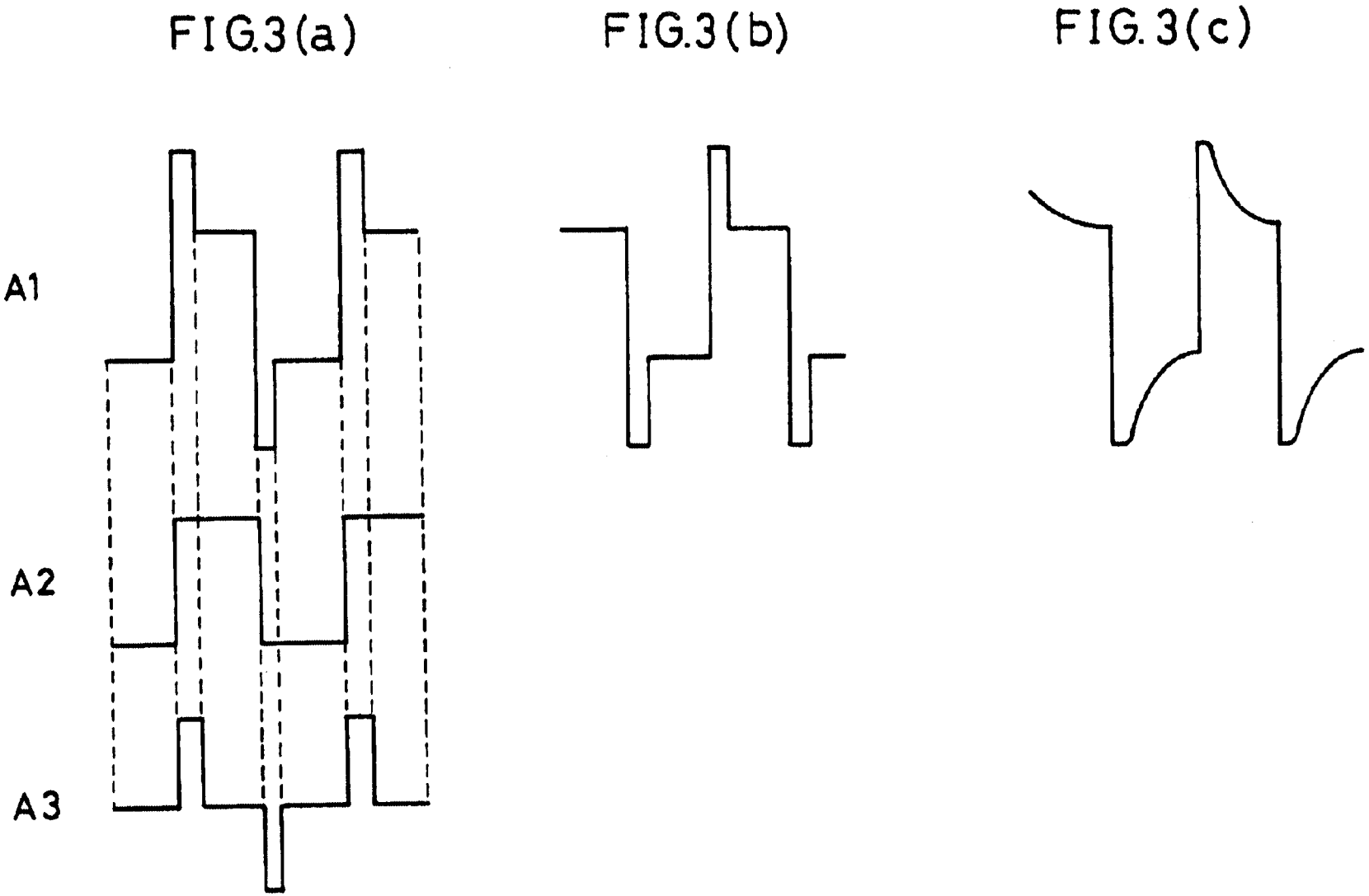
FIG. 3(*a*) is a waveform diagram of a signal inputted to an operational amplifier provided in the driving circuit and two types of signal composing the foregoing signal.

Next, the following will explain an original input waveform which is a characteristic of the present invention. In the present embodiment, a wave (driving signal) A1 having a waveform shown in FIG. 3(*a*) was employed as the original input. The wave A1 is a uniformed wave in which a wave A3 (compensating signal, a second wave) having a rectangular waveform is superimposed on a wave A2 (a first wave) which has a rectangular waveform and forms a base amplitude (amplitude of a reference voltage) so that the rise and fall of the wave A3 synchronize with that of the wave A2, the wave A3 having a half wavelength with a period which is shorter than a period of the waveform A2. FIGS. 3(*b*) and 3(*c*) show the output waveform from the liquid crystal panel 1 and the input waveform to the liquid crystal panel 1, respectively, which are obtained with respect to the foregoing original input.

By thus generating the wave A1 from superimposition of the waves A2 and A3, respective amplitudes of the wave A1 in the rising and falling directions are more surely increased than the wave A2. If the wave A1 as above is used as the original input, a signal inputted to the liquid crystal panel 1 becomes the signal shown in FIG. 3(*c*), and a quantity of charges with which respective pixels of the liquid crystal panel 1 are supplied at the early stages of writing are more surely increased compared with a case where the wave A2 which simply becomes the base of the driving signal is applied to the liquid crystal panel 1. This can be understood with ease from a comparison between FIGS. 3(*c*) and 10(*c*). Thus, a large quantity of charges which can completely compensate for a deficiency in charges at the early stages of writing are supplied through the reference voltage lines 4.

Accordingly, even when a time constant of the reference voltage line 4 becomes larger as the size of the liquid crystal panel 1 is increased, and the charge quantity in each pixel becomes deficient considerably due to wiring delay, a desired charging quantity can be surely supplied in each pixel within desired writing time by employing the wave A1 having a waveform shown in FIG. 3(*a*). For this reason, when, for example, performing black display in the middle of the screen having a half-tone background, a charging quantity in each pixel can be made constant at the both ends of the black display, thereby surely preventing crosstalk having different degrees depending on a location due to difference in a charging quantity while surely improving display quality.

Namely, in the present invention, in a circuit system in which the panel impedance connected to a TFT-LCD pixel electrode is incorporated into a negative feedback circuit (driving circuit 10) adopting an operation amplifier, the driving signal of the liquid crystal panel 1 includes the wave A3 which is the compensating signal for compensating for the shortage of charges with which the respective pixels are supplied at the beginning of respective driving which is repeated periodically, thereby compulsorily supplying respective pixels with a large quantity of charges in shortage ("deficient charge quantity", hereinafter) at the early stages of writing through the reference voltage lines 4. Note that, the foregoing negative feedback circuit has a role of increasing a quantity of charges to be supplied ("charge supply quantity", hereinafter) by detecting deficient charge quantity, where the charge supply quantity fluctuates in accordance with deficient charge quantity.

Further, since crosstalk can thus surely be prevented from generating, the liquid crystal panel 1 can sufficiently be driven even when performing line reversal driving using a low-cost driver with low endurance, thereby realizing a low-cost and high-quality liquid crystal display.

Further, in the present embodiment, since the reference voltage line 4 which is disposed in a direction parallel to the scanning line 3 of the liquid crystal panel 1 is supplied with the driving signal which has been amplified, the respective pixels disposed in the same direction as the scanning line 3 can surely be charged so as to make the charging quantity, for example, constant, thereby surely preventing crosstalk having different degrees depending on a location.

Further, since the wave A3 has a half wavelength with a period which is shorter than that of the wave A2, by generating the wave A1 by synthesizing the waves A2 and A3, the respective amplitudes of the wave A1 in the rising and falling directions are more surely increased compared with the wave A2. Consequently, the quantity of charges with which respective pixels of the liquid crystal panel 1 are supplied can surely be increased at the early stages of writing so as to surely compensate for the deficiency in the charge quantity.

Further, since the wave A3 having a rectangular waveform which is more readily generated than other waves such as a sinusoidal wave is used as a wave to be superimposed on the wave A2, the wave A3 is easily obtained, and a driving signal composed of the waves A2 and A3 can easily be obtained.

Note that, the wave A3 can also be composed of other waves such as a sinusoidal wave. What is required for superimposition is that the wave A3 is superimposed by such a wave A2 as to increase the respective amplitudes of the wave A1 in the rising and falling directions more than the wave A2.

Figure 4A:
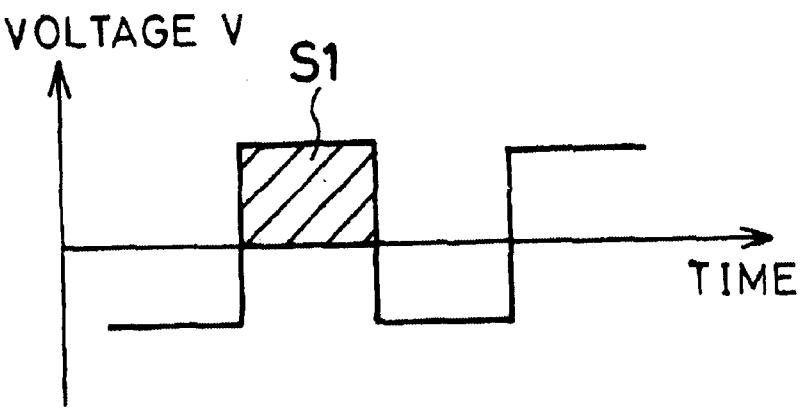
FIG. 4(*a*) is an explanatory drawing showing a relation between time and voltage in a signal which becomes a base of the signal inputted to the operational amplifier.
Figure 4B:
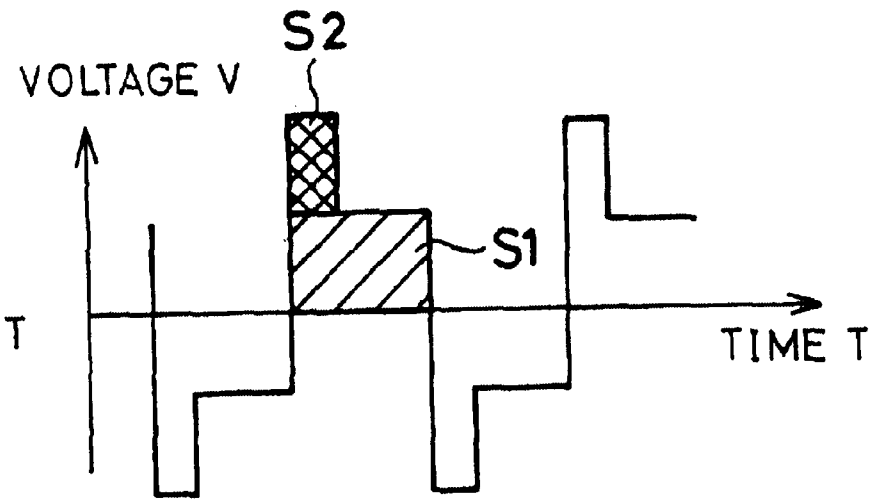
Figure 5:
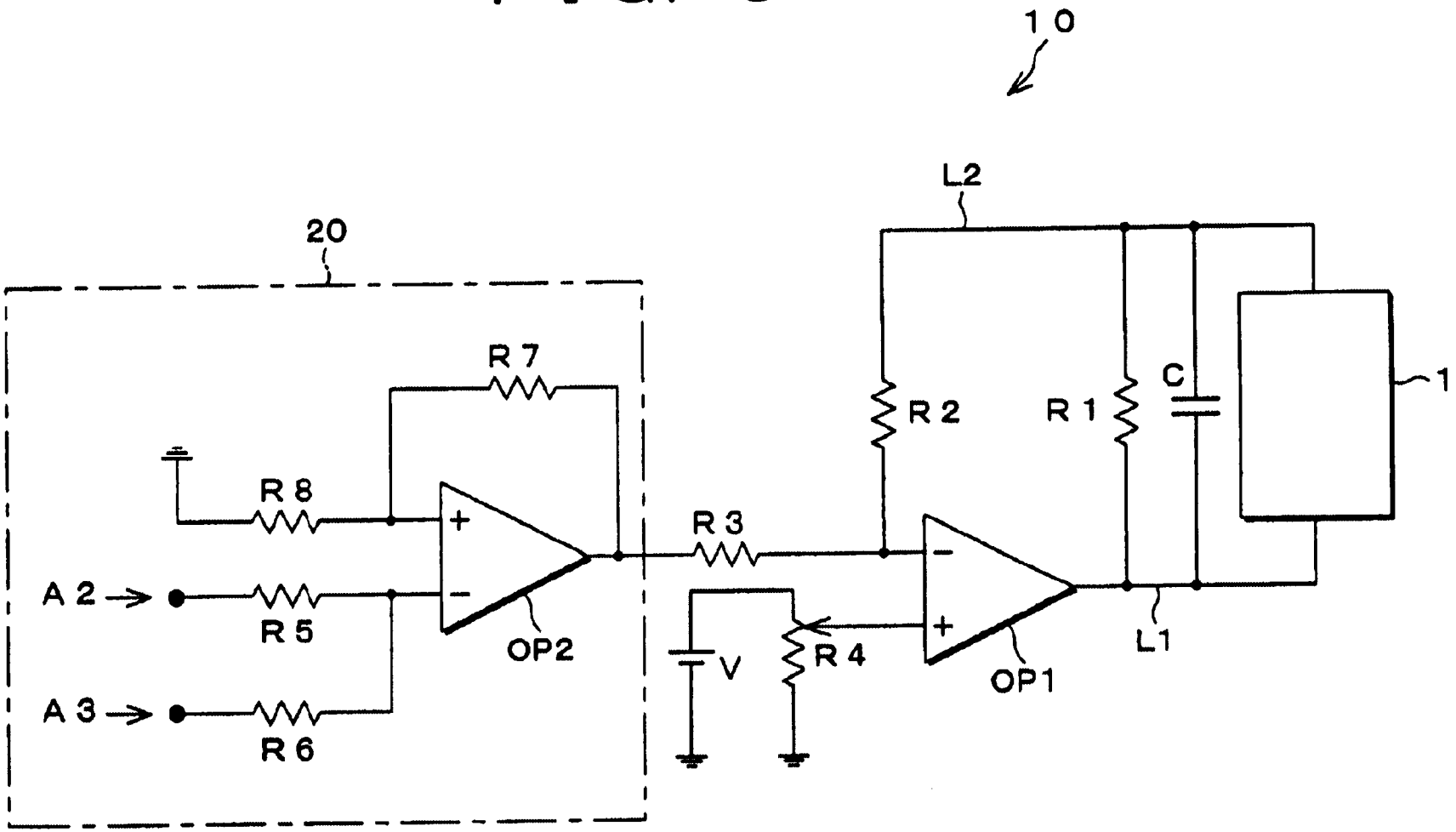
FIG. 5 is an explanatory drawing showing a schematic structure of a liquid crystal panel driving circuit according to another embodiment of the present invention.

Meanwhile, FIG. 4(*a*) shows a relation between time T and voltage V in the wave A2, while FIG. 4(*b*) shows a relation between time T and voltage V in the wave A1. The charge supply quantity is represented by voltage V×time T, which corresponds to an area of a portion enclosed by each wave and a transverse axis shown in FIGS. 4(*a*) and 4(*b*).

Here, when P1 is the charge supply quantity when the liquid crystal panel 1 is supplied with the wave A2, and P2 is the increased quantity of charges ("charge increase quantity", hereinafter) when the liquid crystal panel 1 is supplied with the wave A1, the charge supply quantity P1 corresponds to an area S1 of a portion with oblique lines in FIG. 4(*a*). On the other hand, the charge increase quantity P2 is determined by subtracting the charge supply quantity when supplying the liquid crystal panel 1 with the wave A2 from that when supplying the liquid crystal panel 1 with the wave A1, and it corresponds to an area 52 of the meshed portion in FIG. 4(*b*). That is, in the present embodiment, the liquid crystal panel 1 is compulsorily charged with the charges corresponding to the area S2.

When S2 is not more than (1/16)×S1, i.e. P2 is not more than (1/16)×P1, crosstalk is not sufficiently reduced in the horizontal direction. That is, in this case, if a black window pattern is created on the halftone background, there appears crosstalk of whitish shadow which extends in the horizontal direction. On the contrary, when S2 is not less than (1/4)×S1, i.e. P2 is not less than (1/4)×P1, a voltage becomes relatively higher in the reference voltage line 4, thereby causing adverse effects such as dark shadow extending in the horizontal direction and gradation characteristics deviating, when creating the black window pattern on the half-tone background. Such adverse effects were confirmed in an experiment using a module.

Accordingly, in the present embodiment, the wave A3 is set to become (1/16)×S1<S2<(b 1/4)×S1, i.e. (1/16)×P1<P2<(1/4)×P1, thereby surely preventing the foregoing adverse effects which may be caused by deficient charge supply quantity.

Further, in the present invention, it is also possible to use the wave A1 or the wave A2 depending on how much the charge supplying ability of the reference voltage line 4 is running short.

For example, when $\tau b$ is a time constant of the reference voltage line 4, and $T_{ON}$ is the effective writing time of a panel, it can be arranged in such a manner that the wave A2 is used when the time constant $\tau b$ satisfies $(T_{ON}/12) \leqq \tau b \leqq 1.3\times(T_{ON}/12)$, while the wave A1 is used when the time constant $\tau b$ satisfies $1.3\times(T_{ON}/12)<\tau b \leqq 2.5\times(T_{ON}/12)$. Note that, when the time constant $\tau b$ satisfies $2.5\times(T_{ON}/12)<\tau b$, it can be said that even the use of the wave A1 cannot sufficiently compensate for the deficiency in the charge quantity.

These equations are obtained based on the following: when $T>6\tau$, where $\tau$ is a time constant of a certain bus line and T is effective writing time, charging is performed in the effective writing time T to the extent where discontinuity is not visible to the human (not more than 10 mV for example); however, since the reference voltage line 4 is subject to charging and discharging, the writing time T of $T>2\times6\tau=12\tau$ is necessary.

Namely, the wave A2 can be used sufficiently when. charging and discharging ability of the reference voltage line 4 is running short up to the degree 1.3 times with respect to the value of the effective writing time T (deficiency of 30%). On the other hand, the wave A1 should be used when the charging and discharging ability of the reference voltage line 4 is running short from the deficiency of 30% up to the degree 2.5 times with respect to the value of the effective writing time T (deficiency of 1.5 times with respect to the value of T). Further, when the shortage of the charging and discharging ability of the reference voltage line 4 is not less than 2.5 times with respect to the value of the effective writing time T, even the use of the A1 waveform cannot sufficiently compensate for the deficiency in the charge quantity. This substantially coincides with experimental results.

Thus, by selectively using the wave A1 or the wave A2 depending on how much the charge supplying ability of the reference voltage line 4 is running short to use either of the wave A1 or the wave A2 as the original input, adverse effects, for example, such as the black shadow extending when displaying the black window pattern on the half-tone background, due to excessive charge supply quantity when the deficiency in the charge quantity is small can surely be prevented.

Second Embodiment

The following will explain another embodiment of the present invention with reference to drawings. For ease of explanation, elements of structures having the same functions as those shown in the drawings pertaining to the First Embodiment above will be given the same reference numerals, and explanation thereof will be omitted here.

The present embodiment has an arrangement in which the driving circuit 10 of the First Embodiment further includes an adder circuit 20. The adder circuit 20 is made up of four resistors R5 through R8 and an operational amplifier OP2.

The resistors R5 and R6 are connected to an inverse input terminal of the operational amplifier OP2, and the wave A2 shown in FIG. 3(*a*) is inputted to the operational amplifier OP2 via the resistor R5, while the wave A3 is inputted to the operational amplifier OP2 via the resistor R6. In addition, an output terminal of the operational amplifier OP2 is connected to a non-inverse input terminal thereof via the resistor R7. Further, the non-inverse input terminal is grounded via the resistor R8.

By the foregoing structure, when the separately provided wave A2 and wave A3 whose rise and fall synchronize with the wave A2 are simultaneously inputted to the adder circuit 20, they are added therein, and the wave A1 shown in FIG. 3(*a*) is obtained as the output of the operational amplifier OP2. Thereafter, the operational amplifier OP1 amplifies the wave A1 by a value which is obtained by dividing the synthetic impedance composed of the resistors R1 and R2, capacitor C, and panel impedance of the liquid crystal panel 1, by the value of the resistor R3, then, the wave A1 is inputted to the liquid crystal panel 1.

Thus, the present embodiment has an arrangement in which the wave A2 and wave A3 are separately inputted to the adder circuit 20, and the wave A1 having such a waveform as to give a desired charging quantity to respective pixels within writing time can also be obtained with this arrangement. Accordingly, even with the arrangement in which the driving circuit 10 includes the adder circuit 20 as in the present embodiment, the same functions and effects as the First Embodiment can be obtained.

Note that, the adder circuit 20 may also have an arrangement which generates the wave A1 through addition by inversion of the two types of wave, or addition of one wave to the other by subtracting it.

Note that, the First and Second Embodiments explained a case adopting the liquid crystal panel 1 in which a signal line is provided on the side of the counter substrate, but the present invention can equally be applied to a liquid crystal panel having a signal line on the side of the pixel substrate. In that case, in a circuit system in which a panel impedance connected to a TFT-LCD common electrode is incorporated into a negative feedback circuit employing an operational amplifier, the respective pixels are compulsorily supplied with a large quantity of charges, which are running short at the early stages of writing, via a common electrode line.

Note that, Japanese Unexamined Patent Publication No. 204718/1990 (Tokukaihei 2-204718 published on Aug. 14, 1990), for example, discloses a structure to prevent deterioration of image quality by reversing a polarity of a picture signal applied to a plurality of signal lines which are disposed parallel in a vertical direction for every predetermined duration of time, and by pre-charging a voltage of the signal line to an intermediate voltage of the picture signal at the timing of reversing the polarity of the picture signal. However, this prior art is to reduce a change in width of a signal so as to reduce burden imposed on a switching element. This is basically different from the present invention which, in contrast, increases the change in width of the signal so as to sufficiently compensate for a deficiency in the charge quantity.

Further, the foregoing prior art is to prevent crosstalk in a vertical direction (direction to which the signal line extends) by devising a waveform of the voltage applied to the signal line. In contrast, the present invention is to prevent crosstalk in a horizontal direction (direction to which a scanning line extends) by devising a waveform of a voltage applied to a reference voltage line disposed parallel to the scanning line. It should be noted that crosstalk in the vertical direction and crosstalk in the horizontal direction are different in terms of the mechanism by which they are generated, and prevention methods thereof are different as well.

The driving method of the liquid crystal panel according to the present invention may have an arrangement which employs a superimposed wave made up of first and second waves as the driving signal, the first wave being a rectangular wave to be a base of said driving signal, the second wave, to be the compensating signal, capable of increasing respective amplitudes of the first wave in rising and falling directions when the first wave rises and falls, respectively.

In the foregoing structure, by superimposing the first rectangular wave to be the base of the driving signal and the second wave such as a rectangular wave or a sinusoidal wave, the respective amplitudes of the first wave in the rising and falling directions are increased more than those in a state before the superimposition. By using thus superimposed signal as the driving signal of the liquid crystal panel, the quantity of charges with which respective pixels of the liquid crystal panel are supplied at the early stages of writing is also surely increased in accordance with increase in the amplitudes.

Consequently, even when a time constant of wiring for supplying the charges is increased with the increasing size of the liquid crystal panel while a deficient charge quantity in respective pixels due to wiring delay becomes considerably large, the use of the foregoing driving signal enables the respective pixels to surely obtain a desired charging quantity within desired writing time. Consequently, when, for example, performing black display in the middle of a screen having a half-tone background, the charging quantity of the respective pixels can be made constant at the both sides of the black display, thereby surely preventing crosstalk having different degrees depending on a location due to difference in a charging quantity while surely improving display quality.

The driving method of the liquid crystal panel according to the present invention may have an arrangement which employs, as the driving signal, a wave which results from addition of the first and second waves which have been separately inputted, the first wave being a rectangular wave to be the base of the driving signal, the second wave, to be the compensating signal, capable of increasing the respective amplitudes of the first wave in rising and falling directions when the first wave rises and falls, respectively.

In the foregoing structure, by thus adding the first wave to be the base of the driving signal and the second wave such as a rectangular wave or a sinusoidal wave, which have been separately inputted, the respective amplitudes of the first wave in the rising and falling directions are increased more than those in the state before the addition of the second wave. Note that, the foregoing addition may include various methods such as inverse addition and addition of a subtracted wave. By employing the signal after addition as the driving signal of the liquid crystal panel, the quantity of charges with which respective pixels of the liquid crystal panel are charged at the early stages of writing is also surely increased in accordance with increase in the amplitudes.

Consequently, even when the time constant of wiring for supplying the charges is increased with the increasing size of the liquid crystal panel while the deficient charge quantity in the respective pixels due to wiring delay becomes considerably large, the use of the foregoing driving signal enables the respective pixels to surely obtain a desired charging quantity within desired writing time. Consequently, when, for example, performing black display in the middle of the screen having the half-tone background, the charging quantity of the respective pixels can be made constant at the both sides of the black display, thereby surely preventing crosstalk having different degrees depending on a location due to difference in a charging quantity while surely improving display quality.

The driving method of the liquid crystal panel according to the present invention may have an arrangement in which the driving signal is supplied by being amplified to the wiring which is disposed parallel to the scanning line to scan each pixel of the liquid crystal panel and which supplies the respective pixels with the charges.

In the foregoing structure, since the wiring, for example, such as a reference voltage line and a common electrode line, which is disposed in a direction parallel to the scanning line of the liquid crystal panel is supplied with the amplified driving signal, the respective pixels disposed in the direction parallel to the scanning line can surely be charged, while making the charging quantity of the respective pixels constant in the scanning line direction, thereby surely preventing crosstalk having different degrees depending on a location in the scanning line direction.

The driving method of the liquid crystal panel according to the present invention may have an arrangement in which, when P1 is the charge supply quantity when the liquid crystal panel is supplied with the first wave, and P2 is the charge increase quantity when the liquid crystal panel is supplied with the driving signal, the second wave is set so that the charge increase quantity P2 satisfies $(1/16)\times P1<P2<(1/4)\times P1$.

When P2 is not more than $(1/16)\times P1$, crosstalk is not sufficiently reduced. That is, in this case, if a black window pattern is created on the half-tone background for example, there appears crosstalk of whitish shadow which extends, for example, in the scanning line direction. On the contrary, when P2 is not less than $(1/4)\times P1$ a voltage becomes relatively higher in the wiring which supplies the liquid crystal panel with the charges, thereby causing adverse effects, for example, such as dark shadow extending in the horizontal direction and gradation characteristics deviating, when, for example, creating the black window pattern on the half-tone background.

Accordingly, in the foregoing structure, by setting the second wave to satisfy $(1/16)\times P1<P2<(1/4)\times P1$, the foregoing adverse effects can surely be prevented, thus improving display quality.

The driving method of the liquid crystal panel according to the present invention may have an arrangement in which the second wave is a wave having a half wavelength with a period which is shorter than that of the first wave.

In the foregoing structure, by the second wave which is the wave such as a rectangular wave or a sinusoidal wave which has a half wavelength with a period which is shorter than that of the first wave, the respective amplitudes of the driving signal, which is obtained by either superimposition or addition of the second and first waves, in the rising and falling directions are surely increased more than those in the state before the superimposition or the addition, thereby surely increasing the quantity of charges with which the respective pixels of the liquid crystal panel are supplied at the early stages of writing, to surely compensate for the deficiency in the charge quantity.

The driving method of the liquid crystal panel according to the present invention may have an arrangement in which the second wave is a rectangular wave.

The rectangular wave is more easily generated than other waves such as a sinusoidal wave. Therefore, by thus composing the second wave of the rectangular wave, the second wave can readily be obtained, thereby readily generating the driving signal.

The driving method of the liquid crystal panel according to the present invention may have an arrangement in which the panel impedance of the liquid crystal panel is incorporated into the negative feedback circuit adopting the operational amplifier, and the liquid crystal panel is supplied with the driving signal which has been amplified in the negative feedback circuit.

In the foregoing structure, by thus incorporating the panel impedance of the liquid crystal panel into the negative feedback circuit adopting the operational amplifier, in the negative feedback circuit, the driving signal is amplified at an amplification factor which is determined according to the panel impedance. Consequently, the liquid crystal panel is surely supplied with a voltage which is determined in anticipation of a reduction in voltage inside of the panel, thus surely compensating for a deficiency in the charge quantity at the early stages of writing.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A driving method of a liquid crystal panel which employs a driving signal for periodically driving respective pixels of the liquid crystal panel, comprising the step of:

having the driving signal include a compensating signal for compensating for a deficiency of charges with which the respective pixels are supplied at a beginning of respective driving which is repeated periodically;

wherein a superimposed wave made up of first and second waves is employed as the driving signal, said first wave being a rectangular wave to be a base of the driving signal, said second wave, to be said compensating signal, capable of increasing respective amplitudes of said first wave in rising and falling directions when said first wave rises and falls, respectively; and wherein when P1 is a charge supply quantity when the liquid crystal panel is supplied with said first wave, and P2 is a charge increase quantity when the liquid crystal panel is supplied with the driving signal, said second wave is set so that the charge increase quantity P2 satisfies $$(1/16)\times P1<P2<(1/4)\times P1.$$

2. The method as set forth in claim 1, wherein:

said driving signal is supplied by being amplified to wiring which is disposed parallel to a scanning line to scan each pixel of said liquid crystal panel and which supplies the respective pixels with charges.

3. The method as set forth in claim 1, wherein:

said second wave is a wave having a half wavelength with a period which is shorter than that of said first wave.

4. The method as set forth in claim 1, wherein:

said second wave is a rectangular wave.

5. The method as set forth in claim 1, wherein:

a panel impedance of said liquid crystal panel is incorporated into a negative feedback circuit adopting an operational amplifier, and said liquid crystal panel is supplied with said driving signal which has been amplified in said negative feedback circuit.

6. The method as set forth in claim 1, including the step in which:

said respective pixels are charged in accordance with a difference between a voltage of a signal line and a voltage of a reference voltage line during a charging period which is a scanning period, and a voltage of said respective pixels on a side of the reference voltage lines is increased during the charging period of said respective charges so as to reach a predetermined reference voltage value which is least required for preventing crosstalk in a direction of a scanning line to scan the respective pixels of said liquid crystal panel.

7. The method as set forth in claim 6, wherein:

a quantity of charges to be stored in respective pixels of a single gradation is constant during the charging period of said respective pixels.

8. The method as set forth in claim 1, including the step of:

performing line reversal driving on said pixels.

9. A driving method of a liquid crystal panel which employs a driving signal for periodically driving respective pixels of the liquid crystal panel, comprising the step of having the driving signal include a compensating signal for compensating for a deficiency of charges with which the respective pixels are supplied at a beginning of respective driving which is repeated periodically, wherein a third wave which results from addition of a first wave and a second wave which have been separately inputted is employed as the driving signal, said first wave being a rectangular wave to be a base of the driving signal, said second wave, to be said compensating signal, capable of increasing respective amplitudes of said first wave in rising and falling directions when said first wave rises and falls, respectively, and where $\tau b$ is a time constant of said reference voltage line, and $T_{ON}$ is effective writing time of a panel, said first wave is used when the time constant $\tau b$ satisfies $(T_{ON}/12)\leqq\tau b\leqq 1.3\times(T_{ON}/12)$, while said third wave is used when the time constant $\tau b$ satisfies $1.3\times(T_{ON}/12)<\tau b\leqq 2.5\times(T_{ON}/12)$.

* * * * *